US006095575A

United States Patent [19]

Woods

[11] Patent Number: 6,095,575

[45] Date of Patent: Aug. 1, 2000

[54] APPARATUS AND METHOD FOR OPENING AN ACCESS DOOR LOCATED IN AN OUTER SURFACE OF A CYLINDRICAL DRUM OF A TEXTILE LAUNDERING APPLIANCE

[75] Inventor: Robert L. Woods, Johnson City, Tex.

[73] Assignee: Advanced Micro Devices, Inc., Sunnyvale, Calif.

[21] Appl. No.: 09/167,066

[22] Filed: Oct. 6, 1998

[51] Int. Cl.[7] ..... E05B 3/00

[52] U.S. Cl. ..... 292/336.3; 292/163; 292/DIG. 69; 292/173

[58] Field of Search ..... 292/163, DIG. 69, 292/336.3, 164, 173, 170, DIG. 2; 70/465

[56] References Cited

U.S. PATENT DOCUMENTS

| | | | |
|---|---|---|---|
| 2,376,290 | 5/1945 | Stewart | 294/26 |
| 2,476,594 | 7/1949 | Gingrich | 280/47 |
| 3,960,396 | 6/1976 | Miyahara | 292/347 |
| 4,223,931 | 9/1980 | Neary | 292/347 |
| 4,397,489 | 8/1983 | Lind | 292/347 |
| 4,913,479 | 4/1990 | Allison | 292/347 |
| 4,971,375 | 11/1990 | Grecco | 292/347 |
| 5,169,190 | 12/1992 | Franklin | 294/15 |
| 5,280,974 | 1/1994 | Weintroub | 292/164 |

OTHER PUBLICATIONS

Washtex MCR Microcontamination (Clean Room) Laundry System product brochure from Washtex Machinery Company, a Division of White Consolidated Industries, Wichita Falls, Texas, published Jan. 1993, 12 pages.

*Primary Examiner*—B. Dayoan
*Assistant Examiner*—John B. Walsh
*Attorney, Agent, or Firm*—Kevin L. Daffer; Conley, Rose & Tayon

[57] ABSTRACT

An apparatus and method are presented for opening an access door having a latch opposite a hinge. The latch locks the access door in a closed position, and may include a pair of parallel locking pins and a connecting member joining the locking pins. The locking pins extend outwardly from the access door and into a pair of holes in an adjacent portion of a frame surrounding the access door. The latch may also include one or more resilient members (e.g., springs) urging the locking pins into the pair of holes. The connecting member and an adjacent fixed portion of the access door are separated by a distance d, and the locking pins extend a distance l into the pair of holes. The present method includes providing a prying member having a first lateral dimension s where $s \geqq (d+l)$ and a second lateral dimension w where $w \leqq d$. Dimension w of the prying member is inserted between the connecting member and the adjacent fixed portion of the access door. The prying member is then rotated about an axis substantially perpendicular to the planar face of the access door until dimension s exists between the connecting member and the adjacent fixed portion of the access door. The rotating causes the locking pins to exit the pair of holes, thus unlocking the latch. Once the latch is unlocked, the access door may be opened by rotating the access door about the hinge.

18 Claims, 8 Drawing Sheets

APPARATUS AND METHOD FOR OPENING AN ACCESS DOOR LOCATED IN AN OUTER SURFACE OF A CYLINDRICAL DRUM OF A TEXTILE LAUNDERING APPLIANCE

BACKGROUND OF THE INVENTION

1. Field of the Invention

This invention relates to textile laundering appliances (e.g., washing machines) having cylindrical drums which rotate about a horizontal axis during use, and having access doors mounted in outer surfaces of the drum for loading textiles into the drum and for removing laundered textiles from the drum.

2. Description of Related Art

Several different types of textile laundering appliances (e.g., commercial/industrial washing machines) have cylindrical drums which rotate about a horizontal axis during use and have access doors mounted in outer surfaces of the drum for loading textiles (e.g., garments) into the drum and for removing laundered textiles from the drum. One example of such a laundering appliance is a washer/extractor 10 depicted in FIG. 1. FIG. 2 is a cross-sectional view of washer/extractor 10. Washer extractor 10 includes a cylindrical drum 12 mounted within a housing 14. During a typical use, soiled garments are placed within drum 12, drum 12 is filled to a certain level with water, detergent is added to the water in drum 12, and drum 12 is rotated about a horizontal axis 16 in order to flush foreign substances from the garments.

Drum 12 is essentially a hollow cylinder with circular plates covering both open ends of the hollow cylinder. In the embodiment of FIG. 2, drum 12 is divided into two compartments or "pockets" 18*a* and 18*b* of substantially equal volume by a planar partition 20. Partition 20 is perpendicular to and extends between both circular plates of drum 12. Three access doors 22*a–c* in the curved outer surface of drum 12 allow access to pocket 18*a*. Similarly, three access doors 22*d–f* in the curved outer surface of drum 12 allow access to pocket 18*b*. During use, pockets 18*a* and 18*b* are loaded with substantially equal weights of garments to minimize reciprocal motion imparted upon housing 14 by drum 12 due to rotating eccentric masses of wet garments.

Washer/extractor 10 is designed for isolation of laundered and soiled garments, and subsequently has a load side 24 and an unload side 26. Soiled garments may be stored in an area adjacent to load side 24, and are loaded into drum 12 from load side 24. Laundered garments are removed from drum 12 from unload side 26, and may be stored in an area adjacent to unload side 26. As a result, a significant amount of physical separation is achieved between laundered and soiled garments.

Washer/extractor 10 also includes an outer shell 28 surrounding drum 12 having two arcuate shell doors 30*a* and 30*b*. Shell door 30*a* is located on load side 24 of shell 28, and is shown in a closed position. When drum 12 is suitably rotated and shell door 30*a* is in an open position, shell door 30*a* allows access to access doors 22*a–c* for loading soiled garments into pocket 18*a*, and allows access to access doors 22*d–f* for loading soiled garments into pocket 18*b*. Shell door 30*b* is located on unload side 26 of shell 28, and is shown in an open position. As shown, shell door 30*b* allows access to access doors 22*a–c* for removing laundered garments from pocket 18*a*. When drum 12 is suitably rotated, open shell door 30*b* allows access to access doors 22*d–f* for removing laundered garments from pocket 18*b*.

FIG. 3 is a top plan view of an exemplary access door 22 mounted within a frame 32 attached to drum 12. Access door 22 is substantially rectangular, and has a hinge 34 on one side and a latch 36 on a side opposite hinge 34. Latch 36 includes a locking mechanism 38 including two parallel cylindrical locking pins 40 joined by a cylindrical connecting bar 42. Locking pins 40 have axes perpendicular to a planar face of a portion 44 of frame 32 adjacent to the end of access door 22 including latch 36. Connecting bar 42 has an axis perpendicular to the axes of locking pins 40 and parallel to the planar face of portion 44. A pair of springs 46 urge locking mechanism 38 toward portion 44 of frame 32 such that ends 48 of locking pins 40 protrude from access door 22. Portion 44 of frame 32 has two holes 50 dimensioned to receive ends 48 of locking pins 40. When access door 22 is flush with frame 32, access door 22 is in a closed position. When ends 48 of locking pins 40 extend into holes 50 in portion 44 of frame 32, latch 36 is in a locked position. When access door 22 is closed and latch 36 is locked, access door 22 seals an opening in drum 12 and cannot be rotated about an axis 52 through hinge 34 to an open position.

FIGS. 4 and 5 will now be used to describe how a user may open access door 22 manually. In FIG. 4, the user wraps the fingers of his or her left hand 54 around connecting bar 42 and the thumb of hand 54 around a bar 56 fixed to access door 22. The user may then contract the fingers as shown in FIG. 5, compressing springs 46 and moving locking mechanism 38 away from portion 44 of frame 32 such that ends 48 of locking pins 40 exit holes 50 and no longer protrude from access door 22. When ends 48 of locking pins 40 exit holes 50, latch 36 is in an unlocked position. When latch 36 is unlocked, access door 22 may be rotated about axis 52 through hinge 34 to the open position.

A problem arises when opening access doors 22 of washer/extractor 10. Springs 46 of latch 36 of each access door 22 must exert a certain amount of force upon locking mechanism 38 to keep latch 36 locked and access door 22 closed when drum 12 is rotated. Some users do not have sufficient strength in one hand, or even both hands in combination, to unlock latch 36. That is, some users do not have sufficient hand strength to overcome the force exerted by springs 46 and move locking mechanism 38 far enough away from portion 44 of frame 32 such that ends 48 of locking pins 40 retract into access door 22, exiting holes 50 in portion 44 of frame 32. It is not always convenient to relegate the opening of access doors 22 to a user possessing sufficient hand strength, wherein the opening of access doors 22 includes the unlocking of latches 36 therein.

It would thus be desirable to have a tool for opening access doors (e.g., access doors 22) located in outer surfaces of cylindrical drums (e.g., drum 12) of textile laundering appliances (e.g., washer/extractor 10). Such a tool would allow users lacking sufficient hand strength to unlock the latches to open the access doors.

SUMMARY OF THE INVENTION

The problems outlined above are in large part solved by an apparatus and method for opening a hinged access door having a latch opposite the hinge. The latch locks the access door in a closed position. The latch includes at least one locking pin and a connecting member extending outwardly from the at least one locking pin. Each locking pin extends outwardly from the access door and into a corresponding hole in an adjacent portion of a frame surrounding the door. Each locking pin may be slidily connected to a planar face of the access door, and may move in a plane parallel to the planar face of the access door. The latch may also include one or more resilient members (e.g., springs) urging each locking pin into the corresponding hole in the adjacent portion of the frame surrounding the access door.

The latch may include, for example, a pair of parallel locking pins, and the connecting member may join the locking pins together such that they move in unison. The locking pins may have an axis substantially perpendicular to the planar face of the adjacent portion of the frame surrounding the access door. The connecting member may have an axis substantially perpendicular to the locking pins, and the axes of the locking pins may be substantially perpendicular to an edge of the adjacent portion of the access door.

A fixed portion of the access door exists between the connecting member and the frame. The connecting member is located a distance d from the adjacent fixed portion of the access door, and the at least one locking pin extends a distance l into the corresponding hole in the adjacent portion of the frame surrounding the access door. In general, the present method includes providing a prying member having a first lateral dimension s where s>d and a second lateral dimension w where $w \leqq d$. More specifically, $s \geqq (d+l)$. The prying member is inserted between the connecting member and the fixed portion of the access door such that the second lateral dimension w exists between the connecting member and the fixed portion of the access door. The prying member is then rotated about an axis substantially perpendicular to the planar face of the access door until the first lateral dimension s is between the connecting member and the adjacent fixed portion of the access door. The rotating overcomes the urging of the one or more resilient members and causes the at least one locking pin to exit the corresponding hole in the adjacent portion of the frame surrounding the access door, thus unlocking the latch. Once the latch is unlocked, the access door may be opened by rotating the access door about the hinge.

The present apparatus for opening the access door includes the prying member described above and a bar having two opposed ends. One end of the bar is connected to a top portion of the prying member, and the other end of the bar has a handle connected thereto. In one embodiment, the prying member extends from a bottom surface of the bar, and the handle extends from a top surface of the bar. The bar forms an arm for rotating the prying member about an axis passing through the top portion and a bottom portion of the prying member. The bar and handle may be made of metal (e.g., stainless steel), and the prying member may be made of a rigid plastic material such as polytetrafluoroethylene (e.g., Teflon® PTFE) to avoid damaging the connecting member and the adjacent fixed portion of the access door.

The apparatus may also include an alignment disk attached to and extending outwardly from a front edge of the prying member. The alignment disk has an axis parallel to the axis of the prying member, and functions to help maintain the axis of the prying member substantially perpendicular to a planar face of the access door during use. The alignment disk may be made of a rigid plastic material.

The apparatus may also include a safety spur attached to and projecting outwardly from a back edge of the prying member. The safety spur is positioned under the connecting member during use, and functions to keep the prying member between the connecting member and the adjacent fixed portion of the access door. The safety spur may have a recess in an upper surface adapted to receive the member. The safety spur may be made of metal (e.g., stainless steel).

BRIEF DESCRIPTION OF THE DRAWINGS

Other objects and advantages of the invention will become apparent upon reading the following detailed description and upon reference to the accompanying drawings in which.

Figure 1:
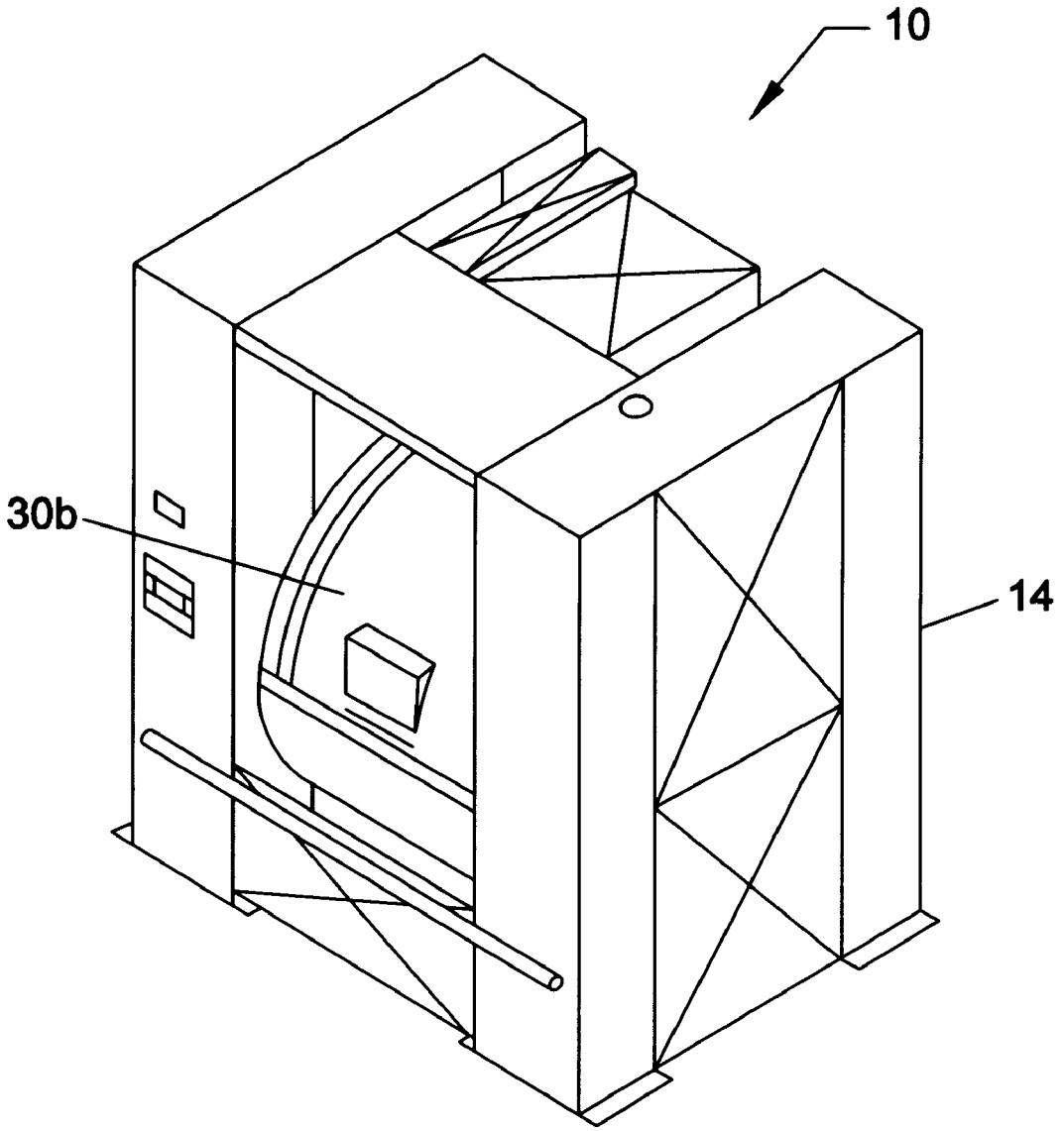
Fig. 1 (Prior Art)
FIG. 1 is an isometric view of an exemplary washer/extractor appliance including a cylindrical drum which rotates about a horizontal axis during use.
Figure 2:
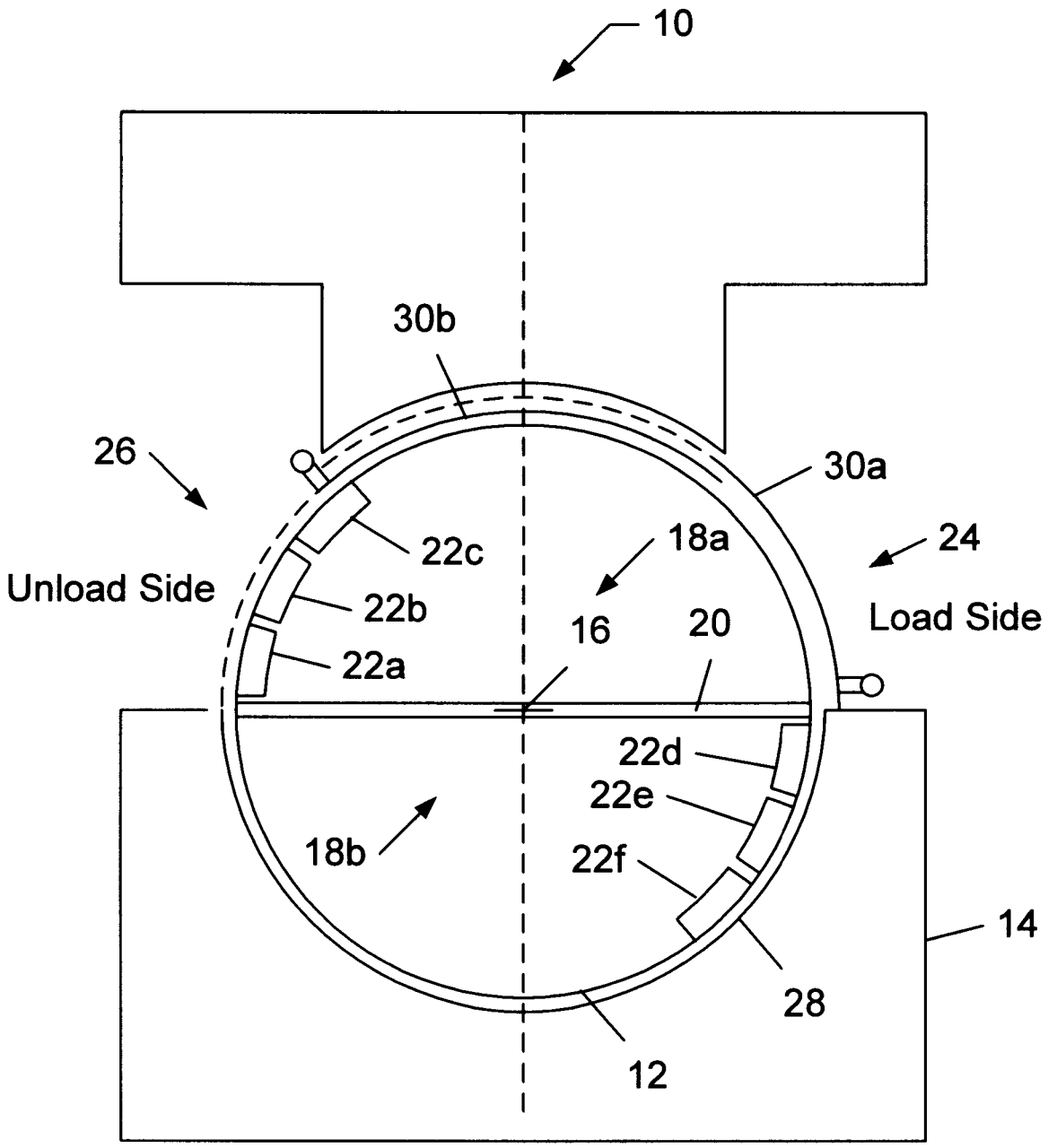
Fig. 2 (Prior Art)
FIG. 2 is a cross-sectional view of the washer/extractor appliance of FIG. 1.
Figure 3:
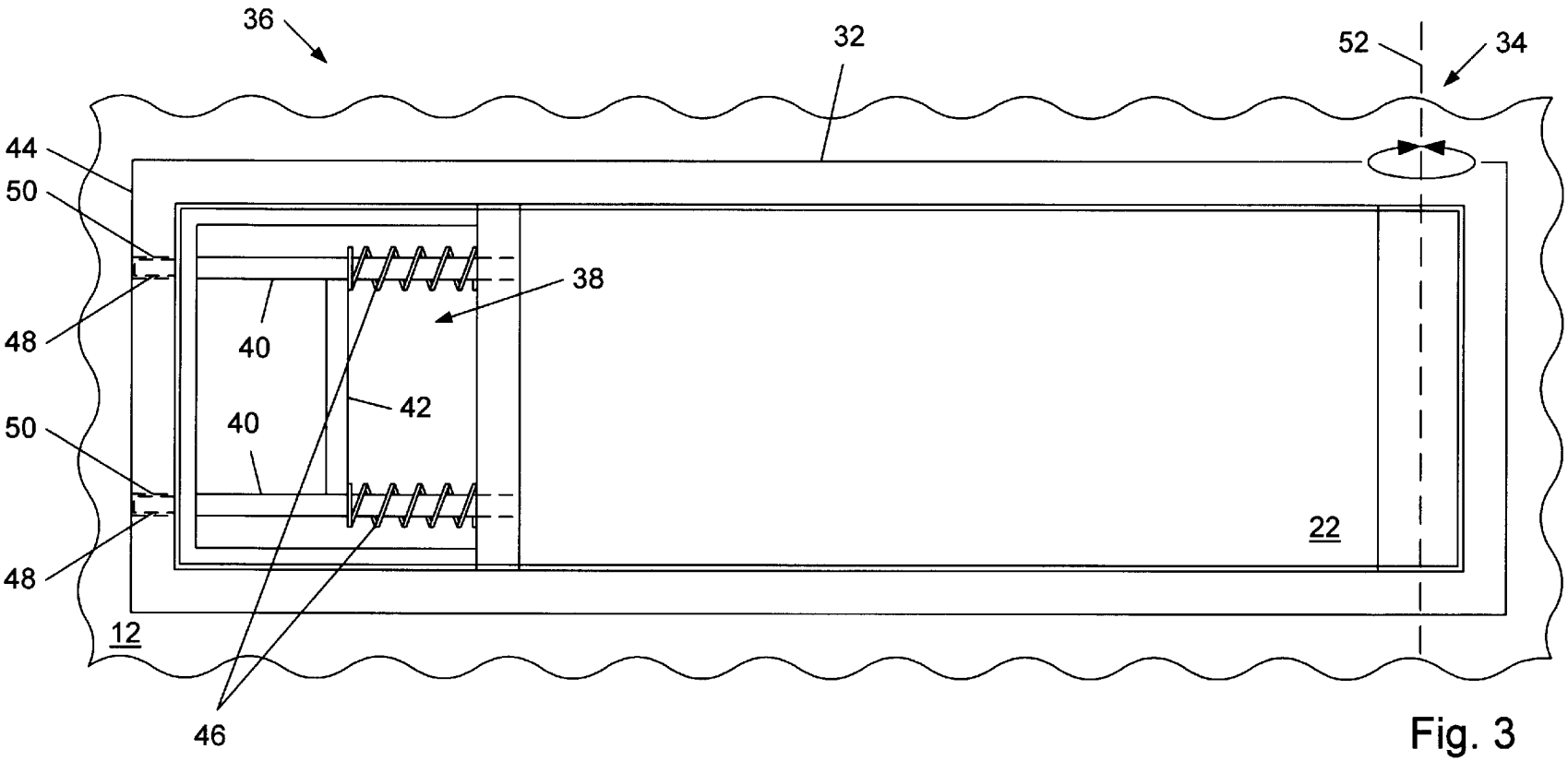
Fig. 3 (Prior Art)
FIG. 3 is a top plan view of an exemplary access door mounted within a frame attached to a surface of the drum of the washer/extractor appliance of FIG. 1, wherein the access door includes a latch opposite a hinge, and wherein the latch includes a pair of parallel locking pins, a connecting member joining the locking pins, and a pair of springs which urge the locking pins into a pair of holes in an adjacent portion of the frame surrounding the access door.
Figure 4:
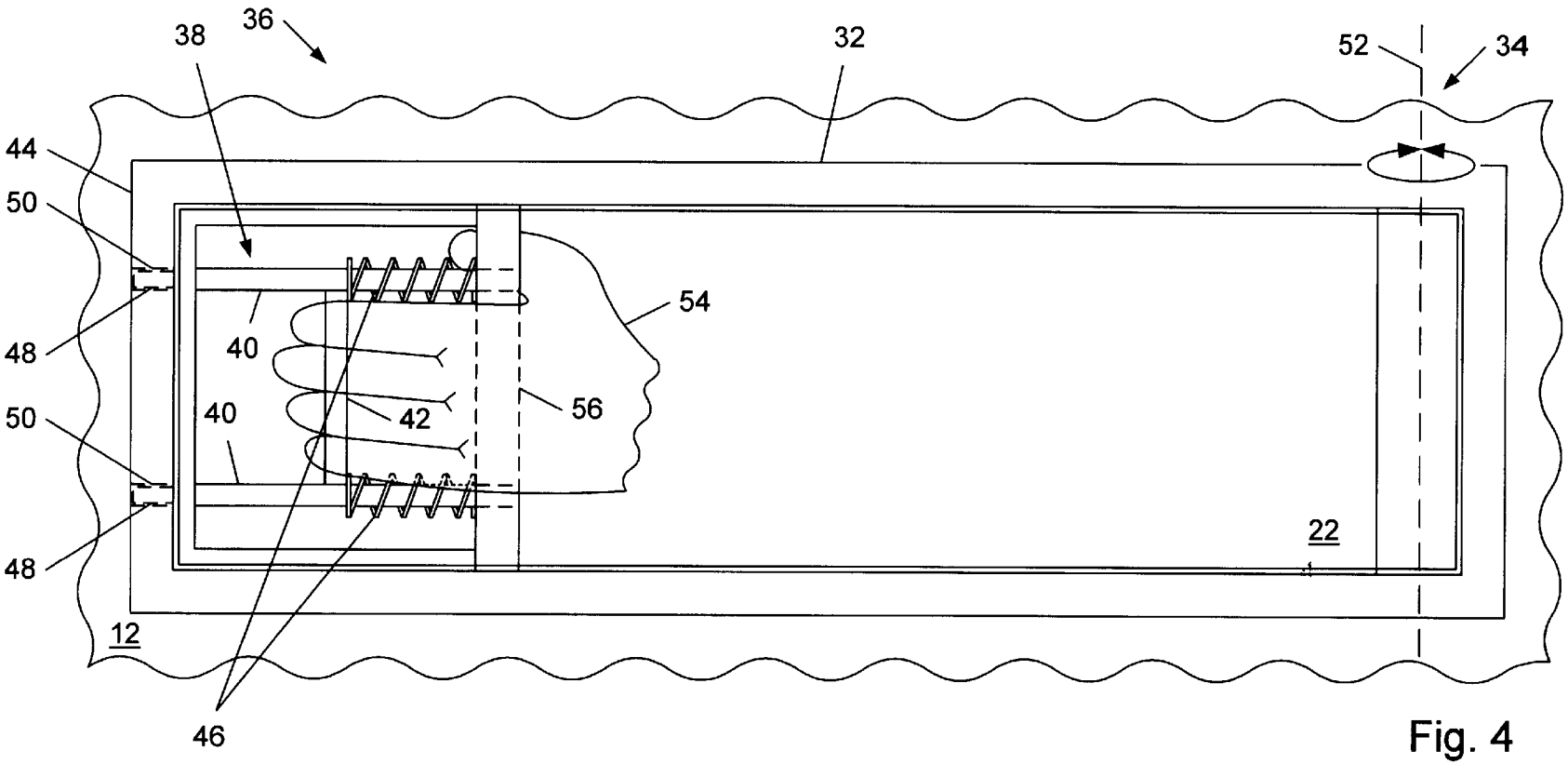
Fig. 4 (Prior Art)
FIG 4. is a top plan of the access door of FIG. 3 illustrating placement of fingers of a user's hand around the connecting member prior to manual unlocking of the latch and opening of the access door.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figures 6A, 6B:
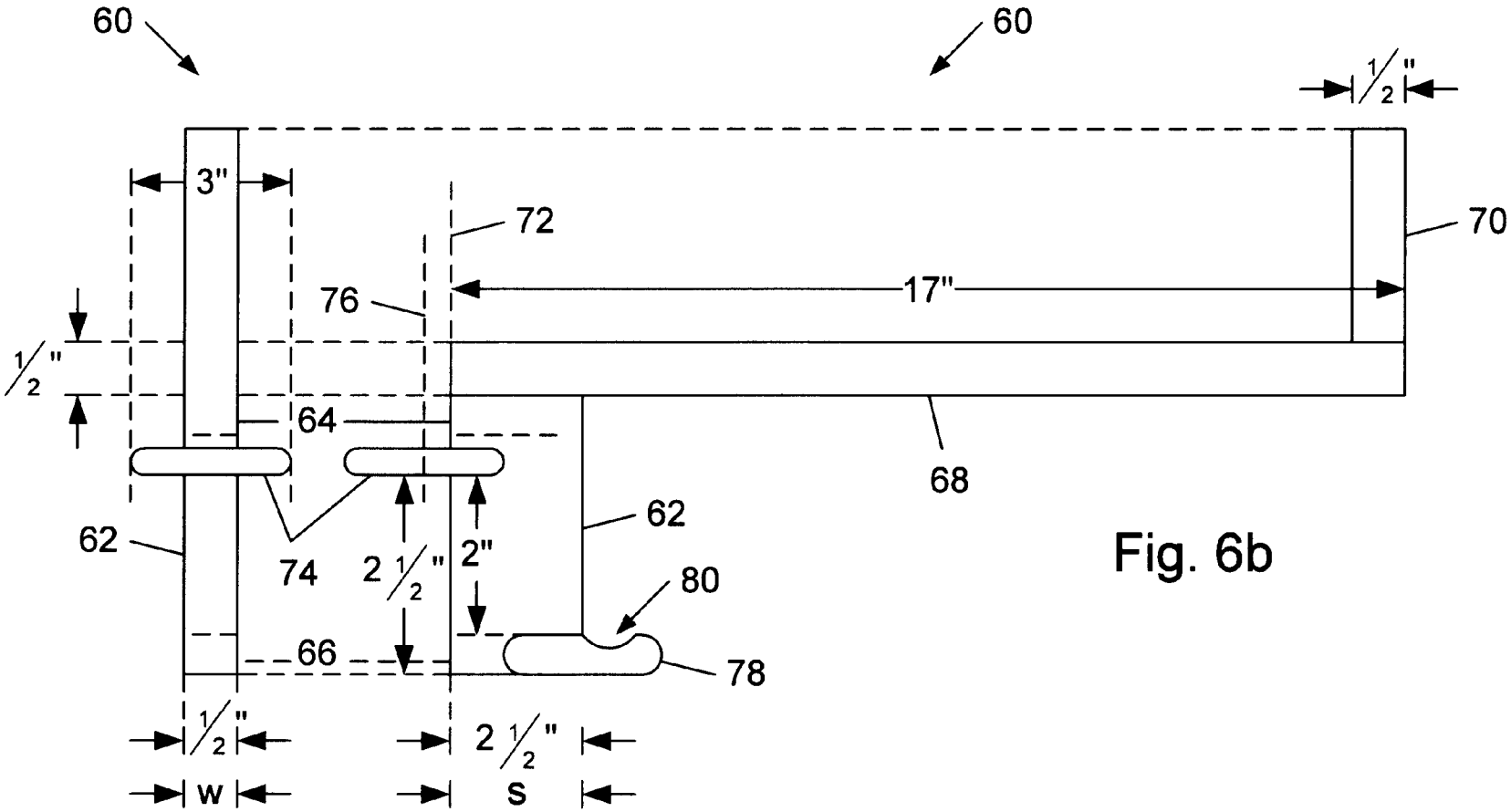
FIG. 6*a* is a front elevation view of one embodiment of an apparatus for opening the access door of FIG. 3, wherein the apparatus includes a prying member connected to one end of a bar and a handle connected to an opposite end of the bar.
FIG. 6*b* is a side elevation view of the apparatus of FIG. 6*a;*

FIG. 6*a* is a front elevation view of one embodiment of an apparatus 60 for opening an access door having a latch comprising at least one locking pin and a connecting member extending outwardly from the at least one locking pin. Each locking pin extends outwardly from the access door and into a corresponding hole in an adjacent portion of a frame surrounding the access door. In the embodiment of the latch depicted herein, the latch includes a pair of parallel locking pins, and the connecting member joins the pair of locking pins together. FIG. 6*b* is a side elevation view of apparatus 60. Apparatus 60 includes a prying member 62 having a top portion 64 and a bottom portion 66, a bar 68 having two opposed ends, and a handle 70. One end of bar 68 is connected to top portion 64 of prying member 62, and the other end of bar 68 is connected to a handle 70. Prying member 62 extends from a bottom surface of bar 68, and handle 70 extends from a top surface of bar 68. Bar 68 forms an arm for rotating prying member 62 about an axis 72 along a front edge of prying member 62 and passing through top portion 64 and bottom portion 66 of prying member 62.

During use of apparatus 60, prying member 62 is inserted between the connecting member and the fixed portion of the access door. Prying member 62 is then rotated about axis 72, causing the connecting member to move away from the fixed portion of the access door and the locking pins to exit the pair of holes in the adjacent portion of the frame surrounding the access door.

Figure 5:
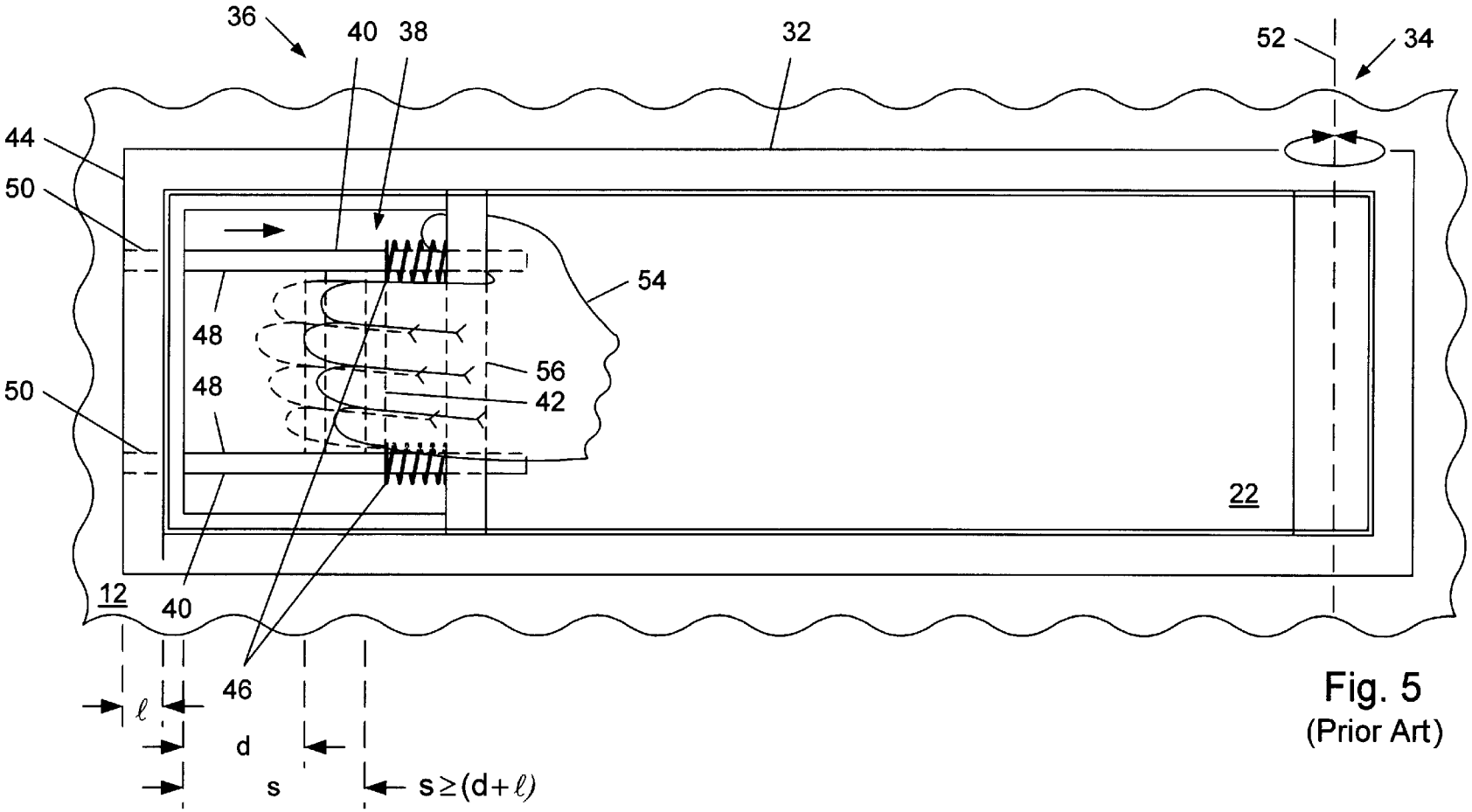
Fig. 5 (Prior Art)
FIG. 5 top plan of the access door of FIG. 4 illustrating how contraction of the fingers of the user's hand compresses the pair of springs and causes the pair of locking pins to exit the holes in the adjacent portion of the frame surrounding the access door, unlocking the access door and permitting the access door to be rotated about the hinge.

FIG. 5 will now be used to describe the physical requirements of prying member 62 in order to accomplish the unlocking of latch 36 and open access door 22. As shown in FIG. 5, locking pins 40 extend a distance l into holes 50 in adjacent portion 44 of frame 32 surrounding access door 22. The connecting member (i.e., connecting bar 42) is separated from an adjacent fixed portion of access door 22 by a distance d. The user may accomplish the unlocking of latch 36 manually by moving connecting bar 42 to a distance s from the fixed portion of access door 22, where $s \geqq (d+l)$. Thus in order for prying member 62 of apparatus 60 to accomplish the unlocking of latch 36, prying member 62 must also move connecting bar 42 to a distance s from the fixed portion of access door 22. Accordingly, prying member 62 has a lateral dimension s as shown in FIG. 6*b*, where $s \geqq (d+l)$. To facilitate insertion of prying member 62 between connecting member 42 and the fixed portion of access door 22, prying member 62 also has a lateral dimension w where $w \leqq d$.

Prying member 62 may be made of, for example, a rigid plastic material in order to prevent damage to connecting bar 42 and the fixed portion of the access door. A suitable rigid plastic material is polytetrafluoroethylene (e.g., Teflon® PTFE). Bar 68 and handle 70 may be made of a metal such as stainless steel.

Apparatus 60 may also include an alignment disk 74 attached to and extending outwardly from the front edge of prying member 62. Alignment disk 74 has an axis 76 parallel to axis 72 of prying member 62. Alignment disk 74 helps maintain axis 72 of prying member 62 substantially perpendicular to a planar face of the access door during use. Alignment disk 74 may contact the fixed portion of the access door during use, and may therefore be made of a rigid plastic material in order to prevent damage to the fixed portion of the access door.

Prying member 68 also has a back edge parallel to the front edge and extending between top portion 64 and bottom portion 66. Apparatus 60 may also include a safety spur 78 attached to and projecting outwardly from the back edge of prying member 62. During use of apparatus 60, safety spur 78 is positioned under the connecting member during use of apparatus 60 in order to maintain apparatus 60 in position between the connecting member and the fixed portion of the access door. Safety spur 78 may be made of a metal such as stainless steel. Safety spur 78 may have a recess 80 in an upper surface adapted to receive the connecting member as shown in FIG. 6*b*.

Figure 7:
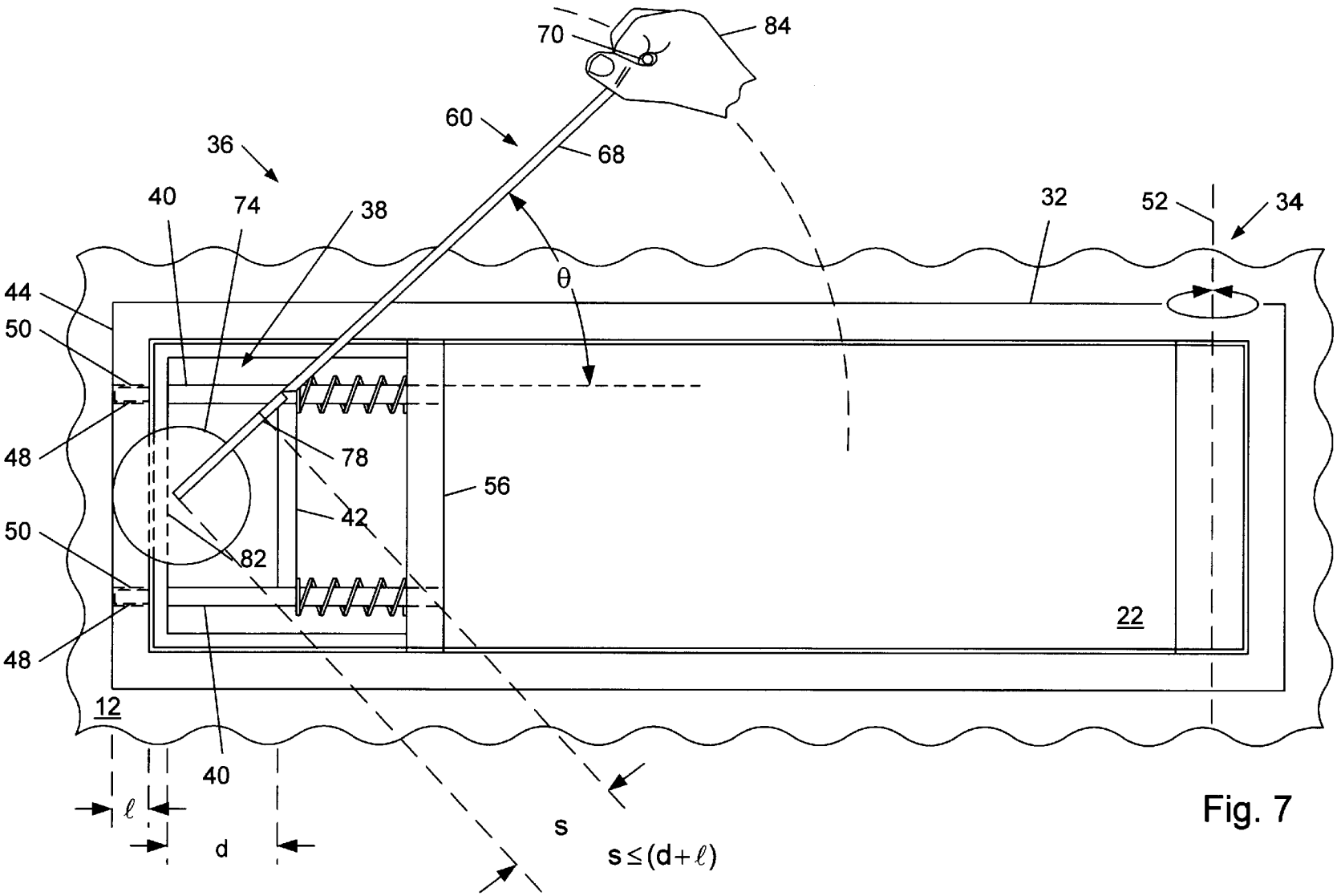
FIG. 7 is a top plan view of the access door of FIG. 3 illustrating the positioning of the apparatus of FIGS. 6*a–b* prior to opening of the latch, wherein the prying member is inserted between the connecting member (i.e., connecting bar) and an adjacent fixed portion of the access door such that an axis of the prying member is substantially perpendicular to a planar face of the access door and an angle θ is formed between the bar of the apparatus and the locking pins of the latch.
Figure 8:
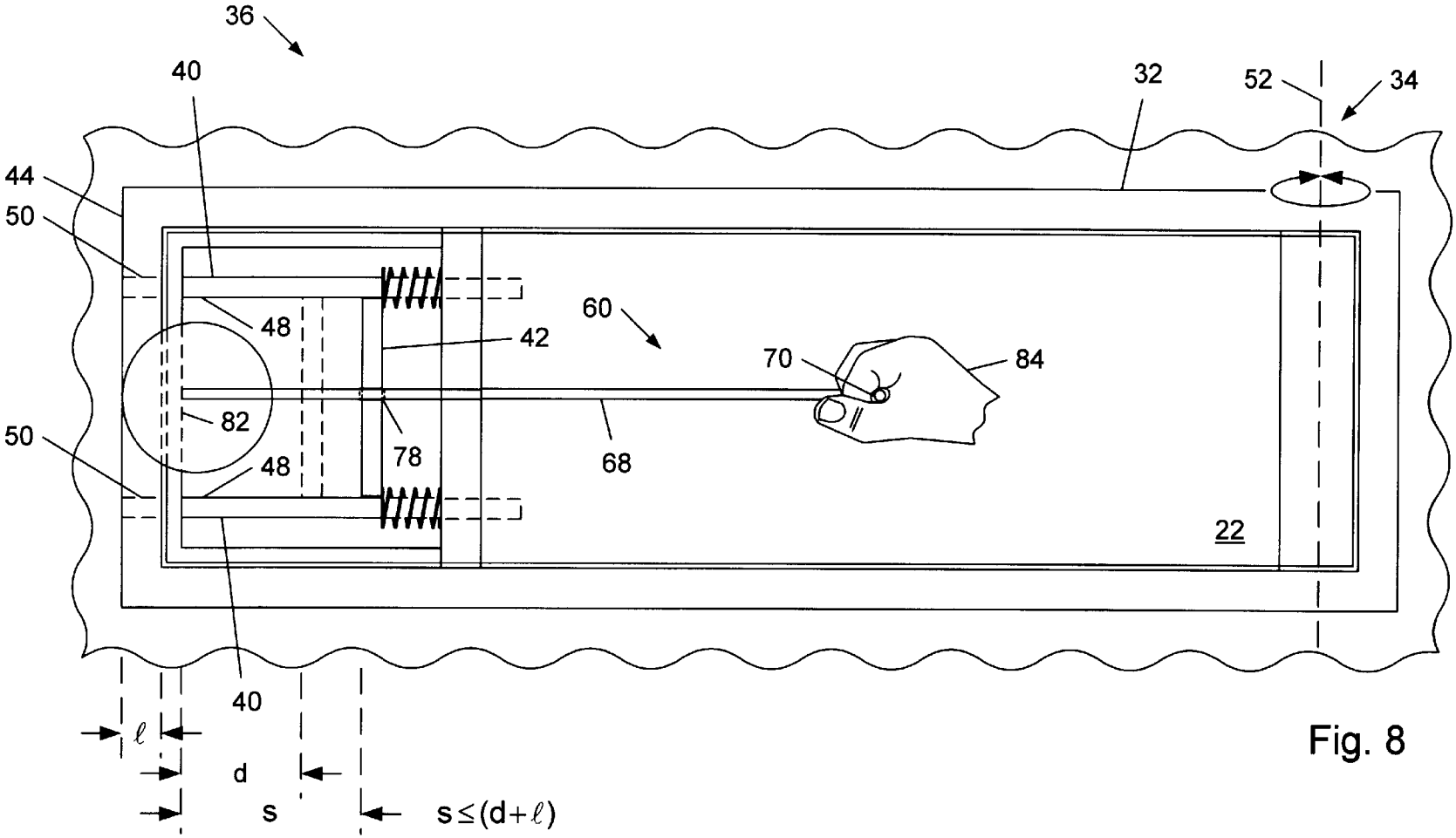
FIG. 8 is a top plan view of the latch of FIG. 3 illustrating how the user unlocks the latch using the apparatus of FIGS. 6*a–b* by rotating the prying member about the axis of the prying member such that angle θ between the bar of the apparatus and the locking pins is reduced to 0 (i.e., the bar of the apparatus is made parallel to the locking pins).

FIGS. 7 and 8 will now be used to describe a method of opening access doors 22 which employs apparatus 60. FIG. 7 shows the positioning of apparatus 60 prior to opening of latch 36. In FIG. 7, ends 48 of locking pins 40 extend into holes 50 in adjacent portion 44 of frame 32 surrounding access door 22, and latch 36 is locked. Dimension w of prying member 62 is inserted between connecting bar 42 and an adjacent fixed portion 82 of access door 22. Bar 68 is used to rotate prying member 62 about axis 72 until the front edge of prying member 62 contacts fixed adjacent portion 82 of access door 22 and the back edge of prying member 62 contacts connecting bar 42. A bottom surface of alignment disk 74 is adjacent to portion 82 of access door 22, and safety spur 78 extends under connecting bar 42.

During the preliminary positioning of apparatus 60, an angle θ is formed between bar 68 and locking pins 40. As described above, a distance d separates fixed adjacent portion 82 of access door 22 and connecting bar 42, and a distance s exists between the front and back edges of prying member 62, where $s \geqq (d+l)$. When lateral dimensions s and w of prying member 62 are substantially perpendicular to one another and dimension s is much greater than dimension w, angle θ is approximately the arc cosine of (d/s).

Once apparatus 60 is positioned as described above, the user grasps handle 70 in, for example, a right hand 84, and applies a force to handle 70 which causes prying member 62 to rotate about axis 72 along the front edge of prying member 62 such that angle θ between bar 68 and locking pins 40 is reduced. The rotation of prying member 62 causes connecting bar 42 to move away from adjacent fixed portion 82 of access door 22, and locking pins 40 to exit holes 50 in adjacent portion 44 of frame 32 surrounding access door 22. In FIG. 8, angle θ between bar 68 and locking pins 40 has been reduced to 0 degrees, and bar 68 is parallel to locking pins 40. Connecting bar 42 has been moved to a distance s from fixed adjacent portion 82 of access door 22, where $s \geqq (d+l)$, and ends 48 of locking pins 40 have exited from holes 50 in adjacent portion 44 of frame 32. Latch 36 is now in the unlocked position, and access door 22 may be rotated about axis 52 of hinge 34 to an opened position. It is noted that safety spur 78 remains under connecting bar 42, preventing prying member 62 from being removed from between adjacent fixed portion 82 of access door 22 and connecting bar 42 without further rotation of bar 68. Following the unlocking of latch 36, access door 22 may be opened by rotating access door 22 about axis 52 of hinge 34.

It will be appreciated by those skilled in the art having the benefit of this disclosure that this invention is believed to be a method and apparatus for opening an access door having a latch comprising a pair of parallel locking pins and a connecting member joining the locking pins, wherein the locking pins extend outwardly from the access door and into a pair of holes in an adjacent portion of a frame surrounding the access door. Such access doors are located in outer surfaces of cylindrical drums of textile laundering appliances. It is intended that the following claims be interpreted to embrace all such modifications and changes and, accordingly, the specification and drawings are to be regarded in an illustrative rather than a restrictive sense.

What is claimed is:

1. A method for opening an access door having a latch comprising a locking pin and a connecting member extending outwardly from the locking pin, the method comprising:

inserting a prying member between the connecting member and an adjacent fixed portion of the access door, wherein the prying member has a first lateral dimension greater than a distance between the connecting member and the adjacent fixed portion of the access door when the latch is in a locked position, wherein the latch comprises a pair of parallel locking pins, and wherein the connecting member joins the locking pins together, and wherein when the latch is in a locked position the locking pins extend outwardly from the access door and into a pair of holes in an adjacent portion of a frame surrounding the access door; and rotating the prying member about an axis substantially perpendicular to a plane defined by the locking pins and the connecting member until the first lateral dimension exists between the connecting member and the adjacent fixed portion of the access door.

2. A method for opening an access door having a latch comprising a locking pin and a connecting member extending outwardly from the locking pin, the method comprising:

inserting a prying member between the connecting member and an adjacent fixed portion of the access door, wherein the prying member has a first lateral dimension greater than a distance between the connecting member and the adjacent fixed portion of the access door when the latch is in a locked position, wherein when the latch is in the locked position the locking pins extend a distance l into the holes in the adjacent portion of the frame surrounding the access door, and wherein the connecting member is separated from the adjacent fixed portion of the access door by a distance d, and wherein the first lateral dimension of the prying member is greater than or equal to (d+l); and rotating the prying member about an axis substantially perpendicular to a plane defined by the locking pins and the connecting member until the first lateral dimension exists between the connecting member and the adjacent fixed portion of the access door.

3. A method for opening an access door having a latch comprising a locking pin and a connecting member extending outwardly from the locking pin, the method comprising:

inserting a prying member between the connecting member and an adjacent fixed portion of the access door, wherein the prying member has a first lateral dimension greater than a distance between the connecting member and the adjacent fixed portion of the access door when the latch is in a locked position, wherein the locking pins are slidily connected to the access door, and wherein the latch further comprises at least one resilient member urging the locking pins into holes, and wherein the rotating overcomes the urging of the at least one resilient member and causes the locking pins to exit the holes; and rotating the prying member about an axis substantially perpendicular to a plane defined by the locking pins and the connecting member until the first lateral dimension exists between the connecting member and the adjacent fixed portion of the access door.

4. A method for opening an access door having a latch comprising a locking pin and a connecting member extending outwardly from the locking pin, the method comprising:

inserting a prying member between the connecting member and an adjacent fixed portion of the access door, wherein the prying member has a first lateral dimension greater than a distance between the connecting member and the adjacent fixed portion of the access door when the latch is in a locked position, wherein the locking pins have axes substantially perpendicular to a planar face of the adjacent portion of a frame surrounding the access door, and wherein an axis of the connecting member is substantially perpendicular to the axes of the locking pins, and wherein the axes of the locking pins are substantially perpendicular to an edge of the adjacent portion of the access door; and rotating the prying member about an axis substantially perpendicular to a plane defined by the locking pins and the connecting member until the first lateral dimension exists between the connecting member and the adjacent fixed portion of the access door.

5. An apparatus for opening an access door having a latch comprising a pair of parallel locking pins and a connecting member joining the locking pins, wherein in a locked position of the latch the locking pins extend outwardly from the access door and into a pair of holes in an adjacent portion of a frame surrounding the access door, and wherein in an open position of the latch the locking pins do not extend into the pair of holes, the apparatus comprising:

a prying member having a top and bottom portions and a first lateral dimension;

a bar having two opposed ends, wherein one end is connected to the top portion of the prying member and the other end has a handle connected thereto; and wherein the apparatus is adapted to transition the latch from the locked position to the open position by inserting the prying member between the connecting member and an adjacent fixed portion of the access door and using the bar to rotate the prying member about an axis substantially perpendicular to a plane defined by the locking pins and the connecting member until the first lateral dimension exists between the connecting member and the adjacent fixed portion of the access door such that the connecting member is moved away from the adjacent fixed portion of the access door and the locking pins exit the pair of holes.

6. The apparatus as recited in claim 5, wherein the prying member further comprises a second lateral dimension, and wherein the second lateral dimension is less than the first lateral dimension, and wherein the second lateral dimension is less than or equal to a distance existing between the connecting member and the adjacent fixed portion of the access door when the latch is in the locked position.

7. The apparatus as recited in claim 6, wherein the bar forms an arm for rotating the prying member about an axis passing through the top and bottom portions of the prying member.

8. The apparatus as recited in claim 5, wherein the prying member extends from a bottom surface of the bar and the handle extends from a top surface of the bar.

9. The apparatus as recited in claim 5, wherein the prying member comprises a rigid plastic material.

10. The apparatus as recited in claim 5, wherein the prying member comprises polytetrafluoroethylene.

11. The apparatus as recited in claim 5, wherein the bar is metal and comprises stainless steel.

12. The apparatus as recited in claim 5, wherein the handle is metal and comprises stainless steel.

13. The apparatus as recited in claim 5, wherein the prying member further comprises opposed front and back edges extending between the top and bottom portions, and wherein the front and back edges are substantially parallel.

14. The apparatus as recited in claim 13, further comprising an alignment disk attached to and extending outwardly from the front edge of the prying member, wherein the alignment disk has an axis parallel to the axis of the prying member, and wherein the alignment disk helps maintain the axis of the prying member substantially perpendicular to a planar face of the access door during use.

15. The apparatus as recited in claim 14, wherein the alignment disk comprises a rigid plastic material.

16. The apparatus as recited in claim 13, further comprising a safety spur attached to and projecting outwardly from the back edge of the prying member, wherein the safety spur is positioned under the connecting member during use.

17. The apparatus as recited in claim 16, wherein the safety spur is metal and comprises stainless steel.

18. The apparatus as recited in claim 16, wherein the safety spur has a recess in an upper surface adapted to receive the connecting member.

* * * * *